United States Patent [19]

Beaussant

[11] Patent Number: 4,616,646

[45] Date of Patent: Oct. 14, 1986

[54] COMPENSATED VALVE FOR BREATHING SYSTEM

[75] Inventor: Raymond Beaussant, Bretigny, France

[73] Assignee: Intertechnique, France

[21] Appl. No.: 711,169

[22] Filed: Mar. 13, 1985

[30] Foreign Application Priority Data

Mar. 14, 1985 [FR] France ..... 84 03945

[51] Int. Cl.[4] ..... A62B 9/02

[52] U.S. Cl. ..... 128/205.24; 137/102; 137/908

[58] Field of Search ..... 128/205.24; 137/102, 137/908

[56] References Cited

U.S. PATENT DOCUMENTS 3,556,122 1/1971 Laerdal ..... 137/102

3,799,185 3/1974 Milnes et al. ..... 137/102

4,428,392 1/1984 Jones et al. ..... 137/102

*Primary Examiner*—Stephen F. Husar

*Attorney, Agent, or Firm*—Larson & Taylor

[57] ABSTRACT

A combined inhalation/exhalation valve for use on a breathing mask for high altitude flights comprises a housing carried by the mask and connectable to a demand regulator. A one-part diaphragm located in the housing controls gas flow. The diaphragm has a cup whose bottom wall is provided with a radial lip seal cooperating with an exhalation seat. The cup is annular. It defines a tore-shaped chamber subjected to the compensation pressure, e.g. to the pressure which prevails in the exhalation line of the regulator connected to the valve. The bottom wall of the cup is further provided with a lip constituting the movable element of an inhalation valve.

10 Claims, 3 Drawing Figures

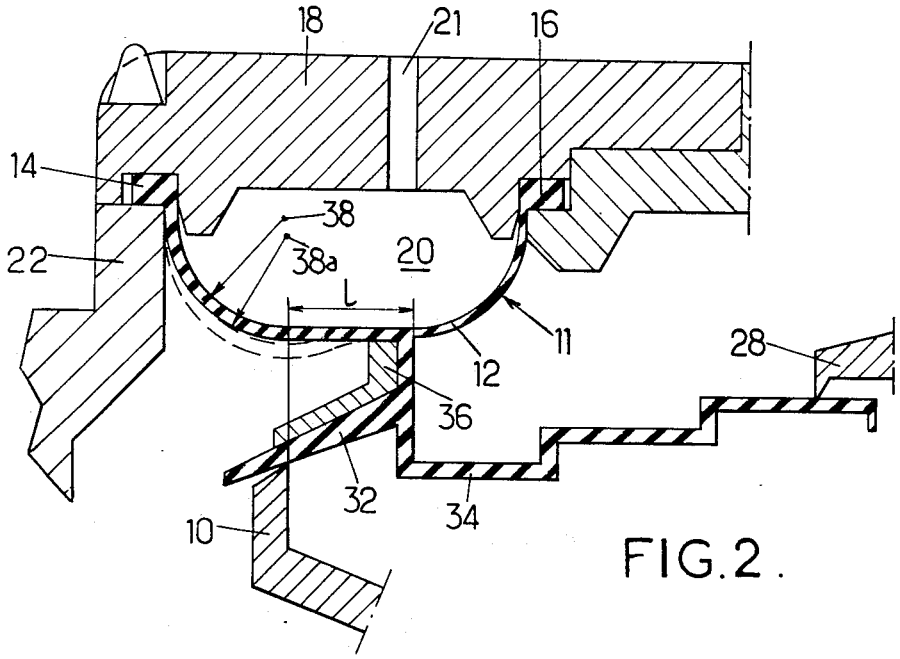
FIG. 2.
FIG. 3.
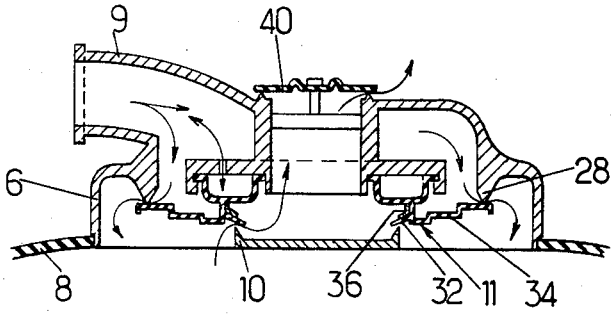

COMPENSATED VALVE FOR BREATHING SYSTEM

BACKGROUND OF THE INVENTION

The invention relates to compensated inhalation-exhalation valves for use in breathing systems, particularly for the crew members of planes operating at high altitude. It more particularly relates to those inhalation-/exhalation valves which are carried by a mask within which an overpressure may prevail and whose gas control member includes a deformable diaphragm having a rotational symmetry, with a cup whose bottom wall is formed with a substantially radial lip seal cooperating with an exhalation seat.

Exhalation valves exist which include a deformable diaphragm and are compensated for the overpressures prevailing within the mask and which are necessary for high altitude flights. Compensation is achieved by an appropriate gas pressure acting against the end wall of the cup, in a direction which biases the lip seal onto its seat. That approach has proved satisfactory up to altitudes attained by the present fighter planes. However, the planes now under development are designed for altitudes and accelerations which may exceed the possibilities of the diaphragm. For instance, it is hardly possible to have a compensation pressure over 50 mbars on the cup. And high load factors may result in a deformation of the diaphragm detrimentally affecting its operation.

It is an object of the invention to provide an improved inhalation/exhalation valve for high altitude high acceleration use. It is a more specific object to provide a valve which is reliable in operation and does not exhibit variations under very high overpressures. It is still another object to provide a valve which can operate under high acceleration loads, the latter result being obtained by a reduction of the weight of the movable parts.

An inhalation/exhalation valve according to the invention comprises a deformable diaphragm having a rotational symmetry, comprising a central cup whose bottom is integral with a substantially radial lip seal cooperating with an exhalation seat, said cup being annular and defining a toroidal chamber in which compensation pressure prevails.

For countering deformation of the diaphragm, a rigid stiffening ring is secured to the diaphragm for transmitting forces between the cup and the lip seal. The stiffening ring may be secured to a cylindrical projection which connects the bottom wall of the cup and the lip seal to a part of that lip seal approximately up to a circular line along which the lip seal cooperates with the exhalation seat.

The cup may include a flat portion and two folds whose shape approximates a quarter of a circle in cross-section. The folds have end rims clamped within a housing. The size and shape of the folds may be such that the effective area subjected to compensation pressure on the diaphragm be substantially equal to the area defined by the line of abutment of the lip seal onto the exhalation seal, or slightly higher for obtaining an overcompensation. The rigid stiffening ring secured to the diaphragm and stop means in the housing may be arranged for limiting "bulging" deformation of the cup, which is preferably so constructed that the center of the fold (which approximately corresponds to the limit of the effective area subjected to the compensation pressure) has a radial movement as small as possible upon modification of the compensation pressure. Overcompensation should remain positive, but must be as low as possible within the complete range of compensation pressure. That overcompensation is in addition to the expiratory head losses. According to the invention, the increase of the amount of overcompensation in response to increase of the compensation pressure, which is frequently found in prior art devices, may easily be avoided.

An inhalation valve may be integrated to the diaphragm as a second lip, radially directed opposite to the lip seal cooperating with the exhalation seat. All functions of the valve may then be fulfilled by a single piece, at the cost of a slight increase in the diameter of the diaphragm.

The invention will be better understood from the following description of particular embodiments of the invention, given by way of examples only.

SHORT DESCRIPTION OF THE DRAWINGS

FIG. 2 is a schematic drawing on an enlarged scale, for illustrating the changes in the shape of the diaphragm when the compensation pressure increases;

Figure 1:
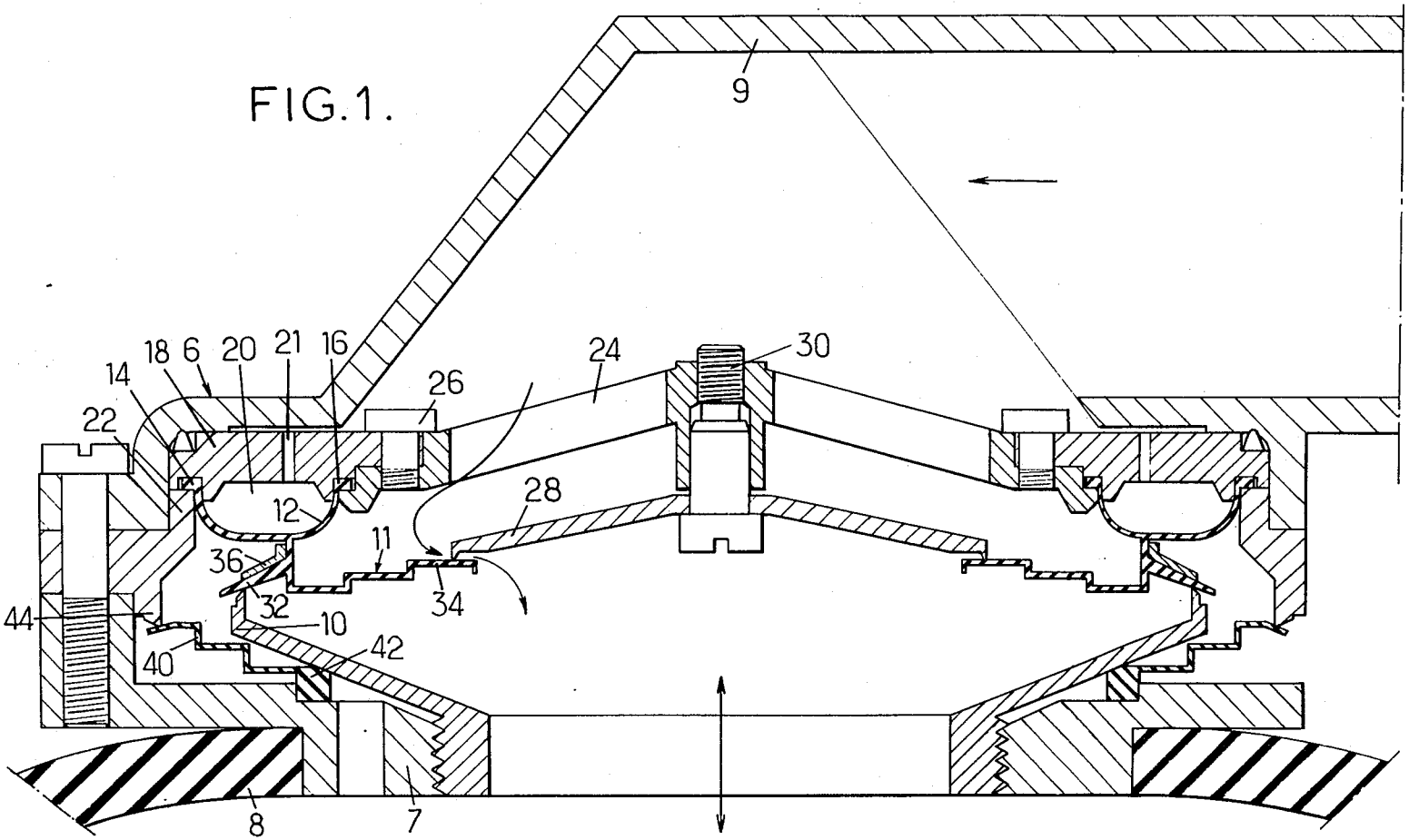
FIG. 1 is a schematic drawing of a compensated inhalation/exhalation valve according to the invention, for use with a demand regulator, in cross-section along an axial plane.

FIG. 3, similar to FIG. 1, is a section of a modified embodiment whose diaphragm is reversed with respect to that of FIG. 1.

DETAILED DESCRIPTION OF PARTICULAR EMBODIMENTS

Referring to FIG. 1, a compensated inhalation-exhalation valve is located in a housing consisting of several parts connected together by conventional means (not shown). The housing 6 is provided with a connector 7 for connection with a respiratory mask shell 8 and with an adaptor 9 for connection with a respiratory gas source through a hose. The source will typically be a demand regulator adapted to provide a respiratory overpressure (not shown). A flaring part located within the connector 7 defines a passage communicating with the inside chamber of the mask shell. It terminates with an exhalation seat 10.

An essential component of the valve consists of a deformable one-part diaphragm 11, of flexible material (typically silicone elastomere). That diaphragm has a complex shape and has a rotational symmetry.

Diaphragm 11 may be considered as comprising an annular cup 12 whose lateral walls are substantially coaxial and are respectively provided with an external radial rim 14 and an internal radial rim 16. Rims 14 and 16 are sealingly applied against a rigid annular part 18, whereby part 18 and cup 12 define a toroidal compensation chamber 20. Calibrated holes 21 formed in part 18 communicate the toroidal (annular) chamber 20 with the inner space of the adaptor 9 for communicating the compensation chamber 20 with the intake pressure.

Rim 14 is clamped between part 18 and an annulus 22 belonging to the housing. Annulus 22 also constitutes a stop for limiting radial outward deformation of the cup, as will be seen later.

Rim 16 is clamped between part 18 and a cover 24 formed with openings for passage of the breathing gas. Cover 24 is connected to part 18 by removable means, for instance screws 26. An inhalation seat 28 is connected to cover 24 by adjustable means making it possible to adjust the axial position of the seat, for instance a threaded connection 30.

The bottom wall of cup 12 is integral with a substantially cylindrical tubular section. That section is forked into a lip seal 32 which constitutes an exhalation valve cooperating with the seat 10 and a lip 34 which constitutes an inhalation valve cooperating with a seat 28. As illustrated in FIG. 1, lips 32 and 34 are respectively directed radially outwardly and radially inwardly.

The external lip 32 is flat or preferably slightly conical. A stiffening ring 36, typically of metal, is tightly applied against the tubular section and the greater part of the external lip 32. The lip and section may be quite thin. The stiffening ring 36 extends over a greater part only of the radial extension of the lip 32, typically up to the circle along which lip 32 has a sealing contact with seat 10. That ring is for transmitting forces and particularly forces due to the compensation pressure from the cup to lip seal 32. It will be seen later that the stiffening ring 36 also cooperates with the abutting surface 22 constituting a stop, for guiding the cup and limiting inflation of cup 12 when the latter is subjected to a high compensation pressure.

The internal lip 34 typically has a stepped shape, as illustrated in FIGS. 1 and 2. That shape favorably affects the flexibility. Other shapes are however possible. It has been found that the shape illustrated in FIG. 2 makes it possible to design a unit consisting of diaphragm 12 and stiffening ring 36 having a weight which does not exceed 300 mg. That low weight and the number of abutments found by the diaphragm provide a high-g tolerance and obviate deformation detrimentally affecting operation. It has been found that operation is satisfactory under load factors exceeding 15 g.

Referring to FIG. 2, particulars of the diaphragm which make it possible to use it with high compensation pressures are apparent. The compensation pressures may attain or even exceed 200 mbars. The cup 12 has a flat portion from the root of the tubular section, directed radially outwardly. That flat portion merges with two folds. When the diaphragm is not subjected to pressure and has the shape illustrated in full line in FIG. 2, the center of the part circular external fold is at 38. The diaphragm is so dimensioned that the compensation pressure prevails on an effective area (over a circular whose diameter extends substantially up to the circular line on which the centers 38 are distributed) which is equal to that of the surface defined by the circle along which lip 32 is in sealing contact with seat 10 (or slightly greater for a slight degree of excess in compensation).

The thickness of the flat portion and of the external fold of the cup is so selected that when the deformation which occurs when the exhalation overpressure, (and the compensation pressure) increases up to its maximum value, the center of the fold cross-section remains substantially at the same distance from the axis. As illustrated in FIG. 2, the center moves from 38 to 38*a*. The ring 22 whose cylindrical internal wall constitutes a stop member limiting deformation of the fold leaves the cup free to expand without substantial change in the distance between the center of the cross-section of the fold and the axis. On the other hand, ring 36 maintains the central portion of the flat bottom wall and expansion occurs only in the external zone, thereby maintaining satisfactory compensation.

Since chamber 20 communicates with the inhalation pressure through a calibrated restricted passage 21 only, there is a dashpot effect. The calibrated passage will typically have a diameter of from 0.5 to 1 mm. The dampening effect may be adjusted by proper selection of the diameter of the hole and the area of the annular zone of width l in FIG. 2.

The valve illustrated in FIG. 1 further comprises a non-return safety valve 40, located on the path of the exhalation gas from the exhalation valve to atmosphere. Referring to FIG. 1, valve 40 consists of a stepped diaphragm having an inner bulged portion 42 secured to the housing 6 and having a peripheral part resiliently forced against a seat 44 on part 22. That valve may insure NBC (nuclear-bacteriological-chemical) protection if of high quality elastomer material.

Embodiments other than that illustrated in FIG. 1 are possible. As illustrated in FIG. 3, where the components corresponding to those of FIG. 1 are designated with the same reference numbers, the arrangement is reversed. The lip 32 cooperating with the exhalation seat 10 is located radially inwardly of the lip 34 cooperating with the inhalation seat 28.

What is claimed is:

1. A compensated inhalation/exhalation valve comprising a housing, an exhalation seat in said housing, and a deformable one-part diaphragm having a rotational symmetry about an axis of said exhalation seat, wherein said diaphragm has a cup, a substantially radial lip seal integral with a bottom wall of said cup and cooperating with said exhalation valve and wherein said cup has an annular shape and defines with said housing a tore-shaped chamber for connection to a compensation pressure.

2. An inhalation/exhalation valve comprising a housing, an exhalation seat in said housing, a deformable diaphragm of elastomere material having an annular cup defining with said housing a tore-shaped chamber for connection to a compensation pressure and a substantially radial lip joined to a bottom wall of said cup and cooperating with said exhalation seat, and a rigid stiffening ring connected to said diaphragm for transmitting forces between said cup and said lip seal.

3. Valve according to claim 2, wherein said ring is connected to said diaphragm along a cylindrical section of said diaphragm between said bottom wall of the cup and the lip seal and along a portion of said lip seal terminating at a circle along which said lip seal cooperates with said exhalation seat.

4. Valve according to claim 3, wherein said cup has a wall comprising a flat portion constituting said bottom wall and two end folds having terminal rims for connection to said housing, wherein said folds have such a shape that the effective area over which said compensation pressure acts on the cup for compensation is at most slightly higher than the area defined by the circle along which said lip cooperates with the exhalation seat.

5. Valve according to claim 4, wherein said housing has stop means for limiting radially outward expansion of said cup.

6. Valve according to claim 2, wherein said diaphragm further comprises a lip joined to said bottom wall of the cup, directed opposite to said lip seal and cooperating with an inhalation valve.

7. Valve according to claim 2, wherein said tore-shaped chamber is connected to a space where inhalation pressure prevails through restricted orifice means.

8. Valve according to claim 2, further comprising a non-return check valve located on an exhalation gas path between said exhalation seat and atmosphere.

9. Valve according to claim 6, wherein said lip seal is located radially inwardly of the lip which cooperates with the inhalation seat.

10. In a breathing system having a respiratory gas source and a mask shell, a compensated inhalation/exhalation valve for mask mounting comprising a housing; an exhalation seat having an axis in said housing; a deformable diaphragm having a rotational symmetry around said axis and which includes an annular cup defining with said housing a tore-shaped chamber for connection with an inner space of said mask-shell and a substantially radial lip seal integral with a bottom wall of said cup and cooperating with said exhalation seat; wherein said cup has a flat bottom wall and two end folds of part-circular shape provided with terminal rims secured to said housing and said flat portion is joined to the lip seal by a tubular section stiffer than the remander of the diaphragm.

* * * * *